US008073355B2

(12) United States Patent
Lee et al.

(10) Patent No.: US 8,073,355 B2
(45) Date of Patent: Dec. 6, 2011

(54) MEMORY, TONER CARTRIDGE, DEVELOPING DEVICE AND IMAGE FORMING APPARATUS HAVING THE SAME

(75) Inventors: Seung-Gweon Lee, Suwon-si (KR); Jean-Man Sur, Suwon-si (KR); Sam-Seok Choi, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 538 days.

(21) Appl. No.: 12/240,710

(22) Filed: Sep. 29, 2008

(65) Prior Publication Data

US 2009/0214249 A1 Aug. 27, 2009

(30) Foreign Application Priority Data

Feb. 22, 2008 (KR) ..... 10-2008-0016472

(51) Int. Cl.
*G03G 15/00* (2006.01)
*G03G 21/18* (2006.01)

(52) U.S. Cl. ..... 399/90; 399/110; 399/113; 399/102

(58) Field of Classification Search ..... 399/90, 399/107, 110, 113, 114, 119, 120, 252, 258, 399/262

See application file for complete search history.

(56) References Cited

U.S. PATENT DOCUMENTS

| | | | |
|---|---|---|---|
| 4,967,234 | A | 10/1990 | Tani et al. |
| 4,974,020 | A | 11/1990 | Takamatsu et al. |
| 4,977,429 | A | 12/1990 | Tani et al. |
| 5,479,247 | A | 12/1995 | Watanabe et al. |
| 5,493,366 | A | 2/1996 | Satoh et al. |
| 5,499,077 | A | 3/1996 | Endo et al. |
| 5,589,915 | A | 12/1996 | Hashimoto |
| 5,960,238 | A | 9/1999 | Ohgami |
| 6,041,212 | A | 3/2000 | Okada |
| 6,104,888 | A | 8/2000 | Kobayashi |
| 6,134,410 | A | 10/2000 | Nakajima |
| 6,151,459 | A | 11/2000 | Hashimoto et al. |
| 6,215,969 | B1 | 4/2001 | Nomura et al. |
| 6,792,230 | B2 | 9/2004 | Saito et al. |
| 6,934,492 | B2 | 8/2005 | Hiura et al. |
| 6,980,758 | B2 | 12/2005 | Murayama et al. |
| 7,340,197 | B2 | 3/2008 | Murayama et al. |

(Continued)

FOREIGN PATENT DOCUMENTS

| | | |
|---|---|---|
| CN | 1477463 | 2/2004 |

(Continued)

OTHER PUBLICATIONS

Office Action issued in Russian patent application No. 2008148636, mailed Oct. 28, 2009.

(Continued)

*Primary Examiner* — David Porta
*Assistant Examiner* — Jessica L Eley
(74) *Attorney, Agent, or Firm* — Stanzione & Kim, LLP

(57) ABSTRACT

A toner cartridge, a developing device, and an image forming apparatus, in which a memory is provided in the cartridge to be accessible by an image forming apparatus are disclosed. The image forming apparatus includes a developing device detachably attached to the body the image forming apparatus, and a toner cartridge detachably disposed in the developing cartridge, which includes a memory accessible from a surface of the toner cartridge exposed outside the developing cartridge when the toner cartridge is installed in the developing cartridge.

48 Claims, 5 Drawing Sheets

U.S. PATENT DOCUMENTS

| | | | | |
|---|---|---|---|---|
| 7,840,160 | B2 | 11/2010 | Shimomura | |
| 2002/0085857 | A1 | 7/2002 | Kim et al. | |
| 2002/0085887 | A1 | 7/2002 | Schneider et al. | |
| 2003/0161653 | A1 | 8/2003 | Ban et al. | |
| 2004/0001723 | A1 | 1/2004 | Ashida et al. | |
| 2004/0037592 | A1 | 2/2004 | Hiura et al. | |
| 2004/0141763 | A1* | 7/2004 | Tabb et al. | 399/24 |
| 2004/0223772 | A1 | 11/2004 | Nakazato | |
| 2005/0019061 | A1* | 1/2005 | Karakama et al. | 399/111 |
| 2005/0047821 | A1 | 3/2005 | Murayama et al. | |
| 2005/0078978 | A1 | 4/2005 | Suzuki et al. | |
| 2005/0095020 | A1 | 5/2005 | Eom et al. | |
| 2005/0260011 | A1* | 11/2005 | Murayama et al. | 399/111 |
| 2006/0210285 | A1 | 9/2006 | Nakazato | |
| 2006/0269313 | A1* | 11/2006 | Takagi | 399/90 |
| 2006/0285880 | A1 | 12/2006 | Okabe | |
| 2007/0230999 | A1* | 10/2007 | Shimomura | 399/113 |
| 2008/0056772 | A1 | 3/2008 | Utsumi et al. | |
| 2008/0170875 | A1* | 7/2008 | Kim et al. | 399/90 |

FOREIGN PATENT DOCUMENTS

| | | | |
|---|---|---|---|
| CN | 101046661 | | 10/2007 |
| EP | 0395320 | | 10/1990 |
| EP | 0 570 993 | A1 | 11/1993 |
| EP | 0 672 971 | | 9/1995 |
| EP | 1 437 632 | | 7/2004 |
| EP | 1 840 671 | | 10/2007 |
| EP | 1 881 378 | | 1/2008 |
| JP | 60-238873 | | 11/1985 |
| JP | 01-091164 | | 4/1989 |
| JP | 09-022177 | | 1/1997 |
| JP | 10-142910 | | 5/1998 |
| JP | 11-24513 | | 1/1999 |
| JP | 2000-75627 | | 3/2000 |
| JP | 2000-075659 | | 3/2000 |
| JP | 2004-264539 | | 9/2004 |
| JP | 2005-326637 | | 11/2005 |
| JP | 2005-338329 | | 12/2005 |
| JP | 2007-025511 | | 2/2007 |
| KR | 91-1489 | | 1/1991 |
| KR | 10-2001-0061976 | | 7/2001 |
| KR | 10-2005-0033796 | | 4/2005 |
| KR | 10-2006-0034168 | | 4/2006 |
| KR | 10-2006-0128338 | | 12/2006 |
| RU | 2266553 | | 4/2005 |

OTHER PUBLICATIONS

English language translation of Office Action issued in Russian patent application No. 2008148636, mailed Oct. 28, 2009.
English language abstract of JP 2000-075659, published Mar. 14, 2000.
Machine English language translation of JP 2000-075659, published Mar. 14, 2000.
English language abstract of RU 2289835, published Dec. 20, 2006.
English language abstract of JP 2005-338329, published Dec. 8, 2005.
European Search Report issued in EP 09 15 0144, issued Jan. 22, 2010.
English language abstract of JP 2004-264539, published Sep. 24, 2004.
Machine English language translation of JP 2004-264539, published Sep. 24, 2004.
Office Action issued in Russian patent application No. 2008148667, mailed Dec. 11, 2009.
English language translation of Office Action issued in Russian patent application No. 2008148667, mailed Dec. 11, 2009.
Notice of Allowance issued in Russian Application No. 2008148634, mailed Jan. 21, 2010.
Partial English language translation of Notice of Allowance issued in Russian Application No. 2008148634, mailed Jan. 21, 2010.
English language abstract of RU 2,266,553, published Apr. 20, 2005.
English language abstract of JP 2007-025511, published Feb. 1, 2007.
Machine English language translation of JP 2007-025511, published Feb. 1, 2007.
Korean Office Action issued in Application No. 10-2008-0016455, issued Jan. 23, 2009.
English abstract of KR 10-2006-0128338, published Dec. 14, 2006.
English Language abstract of KR 91-1489, published Jan. 31, 1991.
Korean Office Action issued in Application No. 10-2008-0016464, mailed Feb. 6, 2009.
Korean Office Action issued in Application No. 10-2008-0016467, mailed Jan. 30, 2009.
English language abstract of KR 10-2006-0034168, published Apr. 21, 2006.
English language abstract of JP 09-022177, published Jan. 21, 1997.
Machine English language translation of JP 09-022177, published Jan. 21, 1997.
Korean Office Action issued in Application No. 10-2008-0016472, mailed Feb. 5, 2009.
English language abstract of KR 10-2005-0033796, published Apr. 13, 2005.
Korean Office Action issued in Application No. 10-2008-0016469, mailed Feb. 6, 2009.
English language abstract of KR 10-2001-0061976, published Jul. 7, 2001.
European Search Report issued in European Application No. 09 15 0141, mailed Apr. 14, 2009.
Russian Office Action issued Apr. 16, 2010 in RU Application No. 2008148632.
European Search Report issued in EP 09150067.8, mailed Jun. 3, 2009.
English language abstract of JP 60-238873, published Nov. 27, 1985.
English language abstract of JP 01-091164, published Apr. 10, 1989.
Office Action issued in KR 10-32008-0016469, mailed Jun. 3, 2009.
English language abstract of JP 2005-326637, mailed Nov. 24, 2005.
Machine English language translation of JP 2005-326637, mailed Nov. 24, 2005.
Machine English language translation of JP 2005-338329, published Dec. 8, 2005.
Machine English language translation of JP 10-142910, published May 29, 1998.
Machine English language translation of JP 11-24513, published Jan. 29, 1999.
Machine English language translation of JP 2000-75627, published Mar. 14, 2000.
European Search Report Issued in European Application No. 09 15 0066, mailed Jul. 29, 2009.
European Search Report issued in European Application No. 09 15 2590, mailed Aug. 17, 2009.
Russian Decision on Grant issued Dec. 16, 2010 in RU Application No. 2008148632.
Chinese Office Action issued Dec. 31, 2010 in CN Application No. 200810166765.7.

* cited by examiner

MEMORY, TONER CARTRIDGE, DEVELOPING DEVICE AND IMAGE FORMING APPARATUS HAVING THE SAME

CROSS-REFERENCE TO RELATED APPLICATIONS

This application claims priority under 35 U.S.C. §119 from Korean Patent Application No. 10-2008-0016472, filed on Feb. 22, 2008, in the Korean Intellectual Property Office, the disclosure of which is incorporated herein by reference in its entirety.

BACKGROUND OF THE INVENTION

1. Field of the Invention

Aspects of the present invention relate to an image forming apparatus, and more particularly, to a replaceable toner cartridge having a memory, a developing cartridge, a developing device, and an image forming apparatus having the same.

2. Description of the Related Art

General image forming apparatuses such as, e.g., printers, copy machines, fax machines, or multifunctional peripherals print images on printing media using a quantity of toner.

The more pages are printed, the more toner is consumed, and thus the toner needs to be periodically replenished. The toner may be accommodated in a developing cartridge removably installed in the body of the image forming apparatus, together with other components, e.g., a developing roller and/or a supply roller.

To replenishing toner, when the entire developing cartridge is replaced, not only the toner, but also other components, such as, e.g., the developing roller and/or supply roller are also replaced, causing the cost of operational and/or maintenance cost of the image forming apparatus to increase.

The developing cartridge may include a memory such as, e.g., a customer replaceable unit monitor (CRUM), that stores information that can be used to determine, for example, whether the developing cartridge is mounted, the amount of toner remaining, and/or other printing related information.

As various internal components and the driving mechanism to drive these internal components are also disposed in or about the developing cartridge, the placement of the memory device, e.g., a CRUM, at a location that does not contribute greatly to the overall size of the developing cartridge and/or the image forming apparatus, and that also allows the memory device to transmit and/or receive signals to and/or from the image forming apparatus, is desirable.

BRIEF DESCRIPTION OF THE DRAWINGS

Aspects of the present invention will be more apparent from the descriptions of embodiments herein with reference to the accompanying drawings, in which.

DETAILED DESCRIPTION OF SEVERAL EMBODIMENTS

Figure 1:
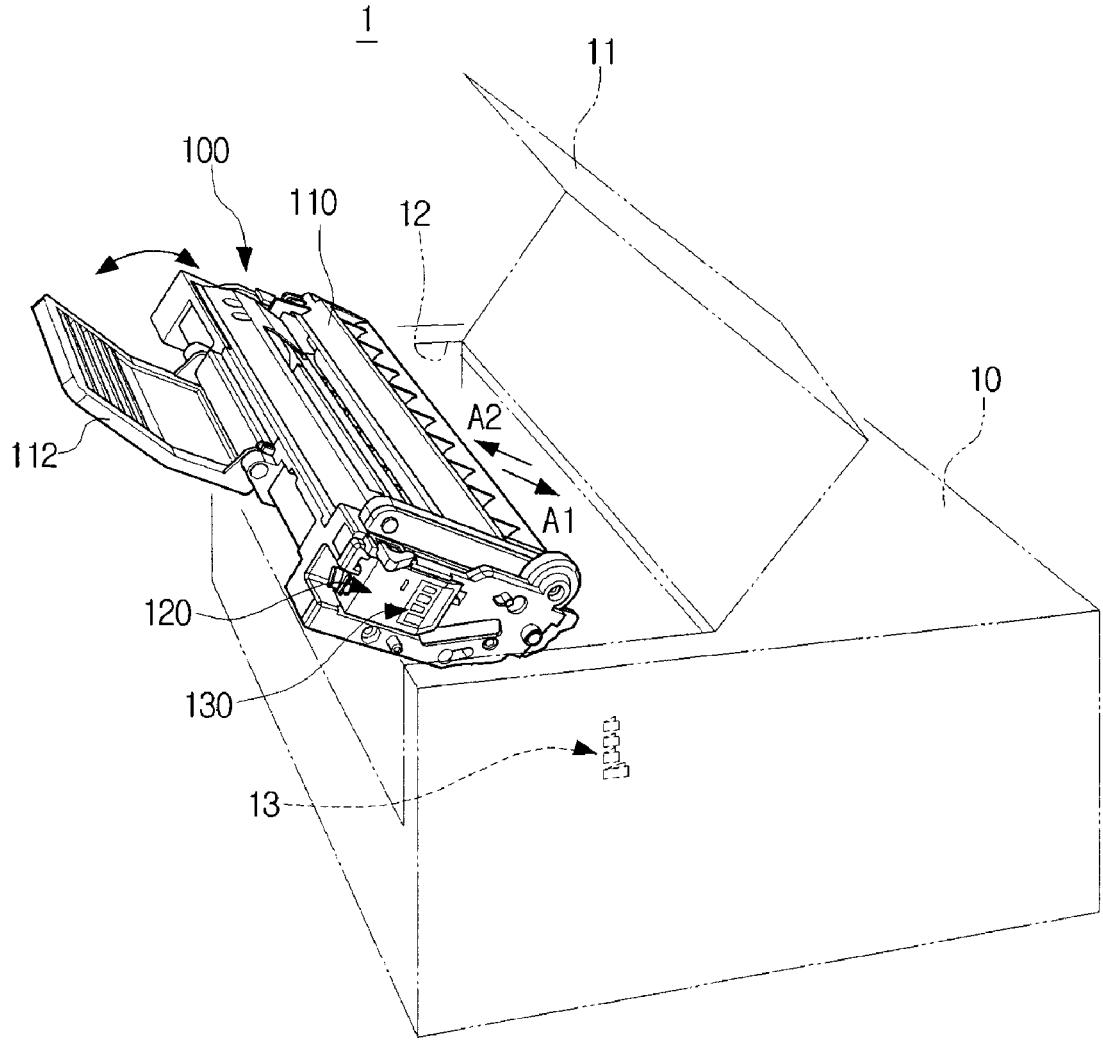
FIG. 1 is a perspective illustrating the mounting of a developing device an image forming apparatus according to an embodiment of the present invention.

Certain exemplary embodiments of the present invention will now be described in greater detail with reference to the accompanying drawings.

In the following description, the same drawing reference numerals are used for the same elements even in different drawings. While the foregoing embodiments are described with detailed construction and elements to assist in a comprehensive understanding of the embodiments, it should be apparent however that the embodiments can be carried out without those specifically detailed particulars. Also, well-known functions or constructions will not be described in detail so as to avoid obscuring the description with unnecessary detail.

FIG. 1 is a perspective view showing a developing device being mounted in an image forming apparatus according to an embodiment of the present invention. Referring to FIG. 1, an image forming apparatus 1 may include a body 10 and a developing device 100.

The body 10 (only an outline of which is shown) may includes parts to performing operations to print an image on a printing medium transferred along a printing path including, for example, a feeding unit, fusing unit, and/or transferring unit, or the like. Functions of these parts housed in the body 10 for printing an image are well known to those skilled in the art, so a detailed description is omitted here for the sake of brevity.

Figure 2:
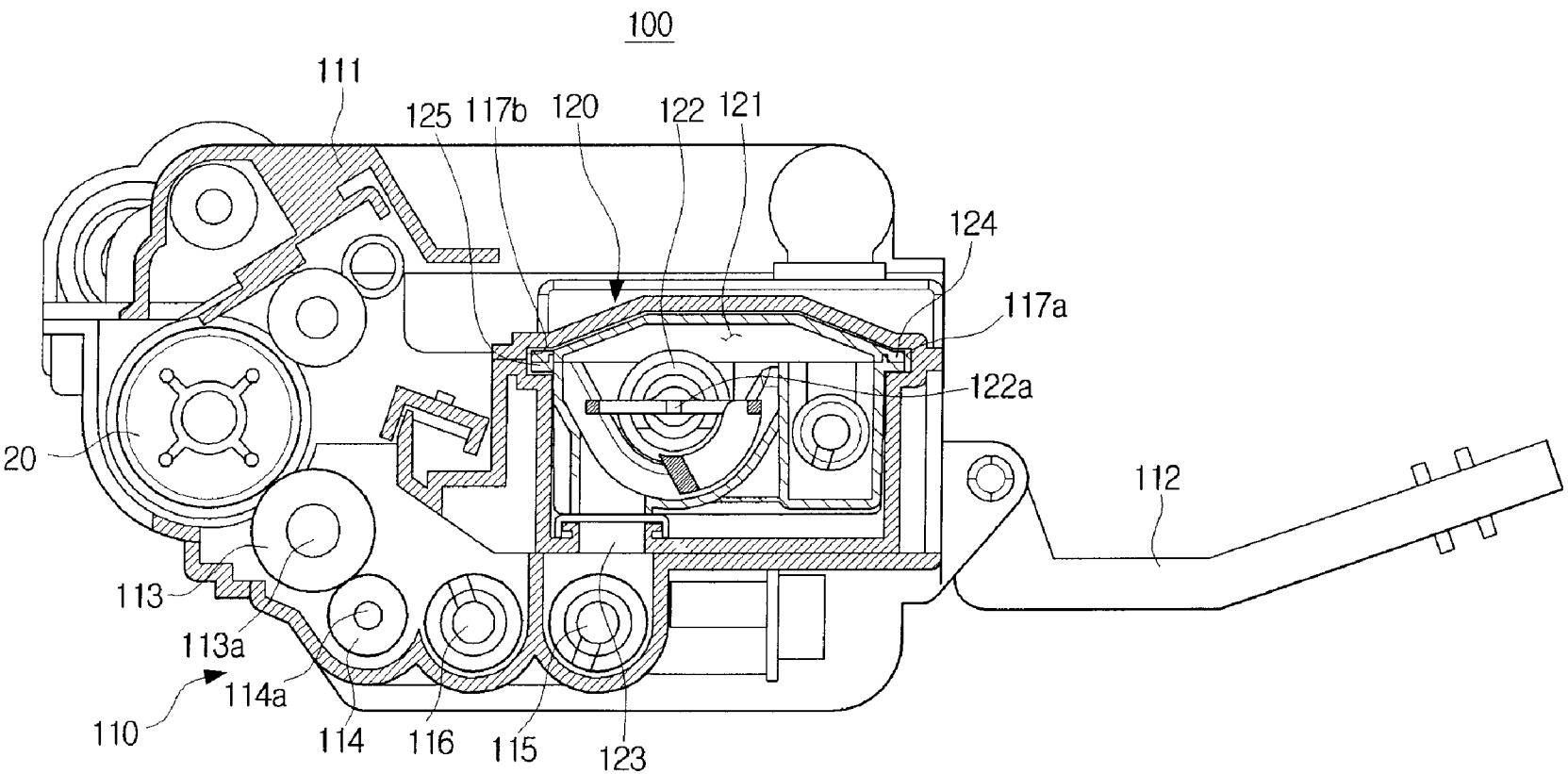
FIG. 2 is a sectional view illustrating the developing device of FIG. 1.

FIG. 2 is a sectional view illustrating the developing device 100 shown FIG. 1. The developing device 100 may include a developing cartridge 110 and a toner cartridge 120.

The developing cartridge 110 may be detachably supported in the body 10 of the image forming apparatus 1. More specifically, the inside of the body 10 may be accessed by opening a cover 11 as shown in FIG. 1, allowing the developing cartridge 110 to enter the body 10 in the direction indicated by arrow A1, and to be mounted within a casing 12 of the body 10.

Figure 3A:
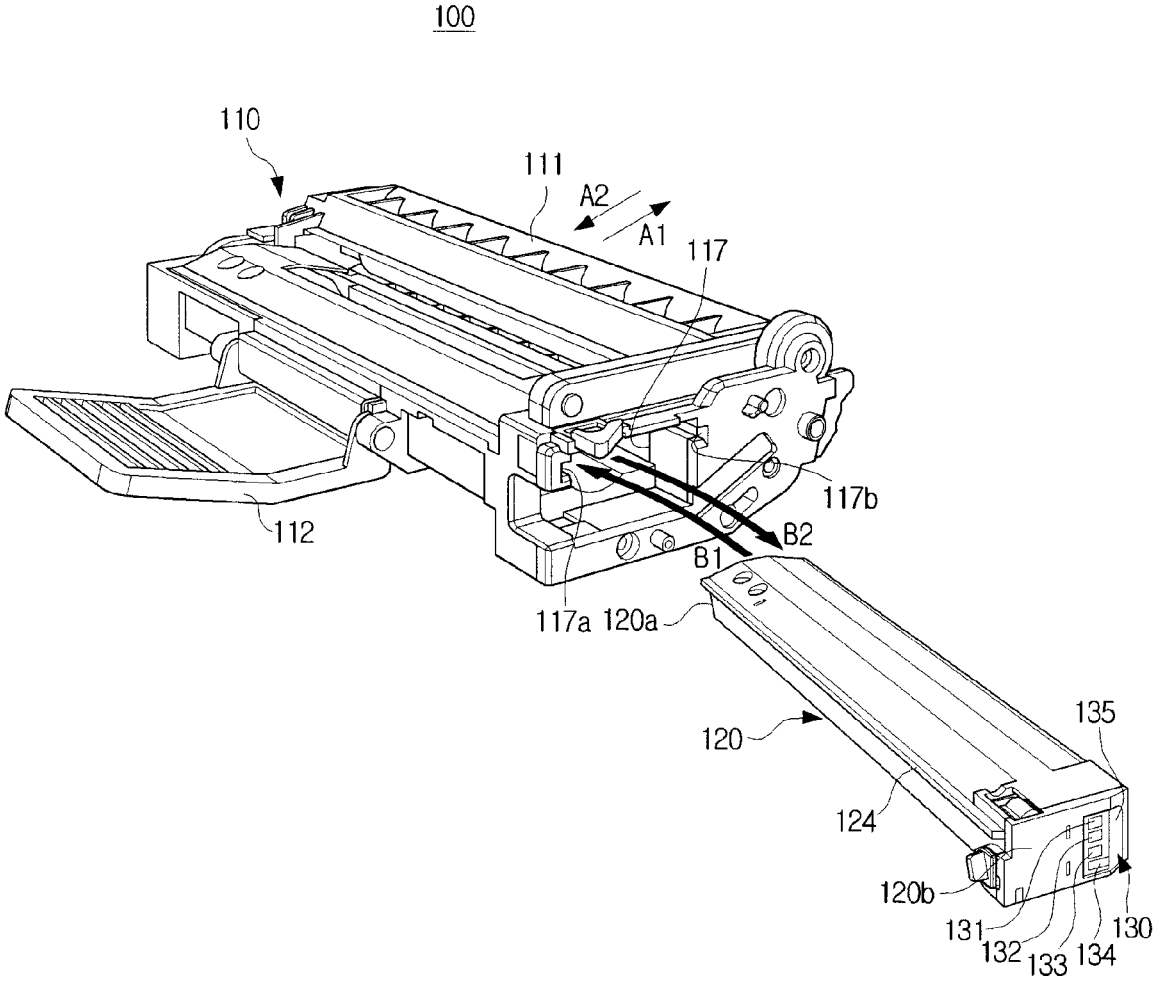
FIGS. 3A and 3B are perspective views illustrating the mounting of a toner cartridge in a developing cartridge according to an embodiment of the present invention.
Figure 3B:
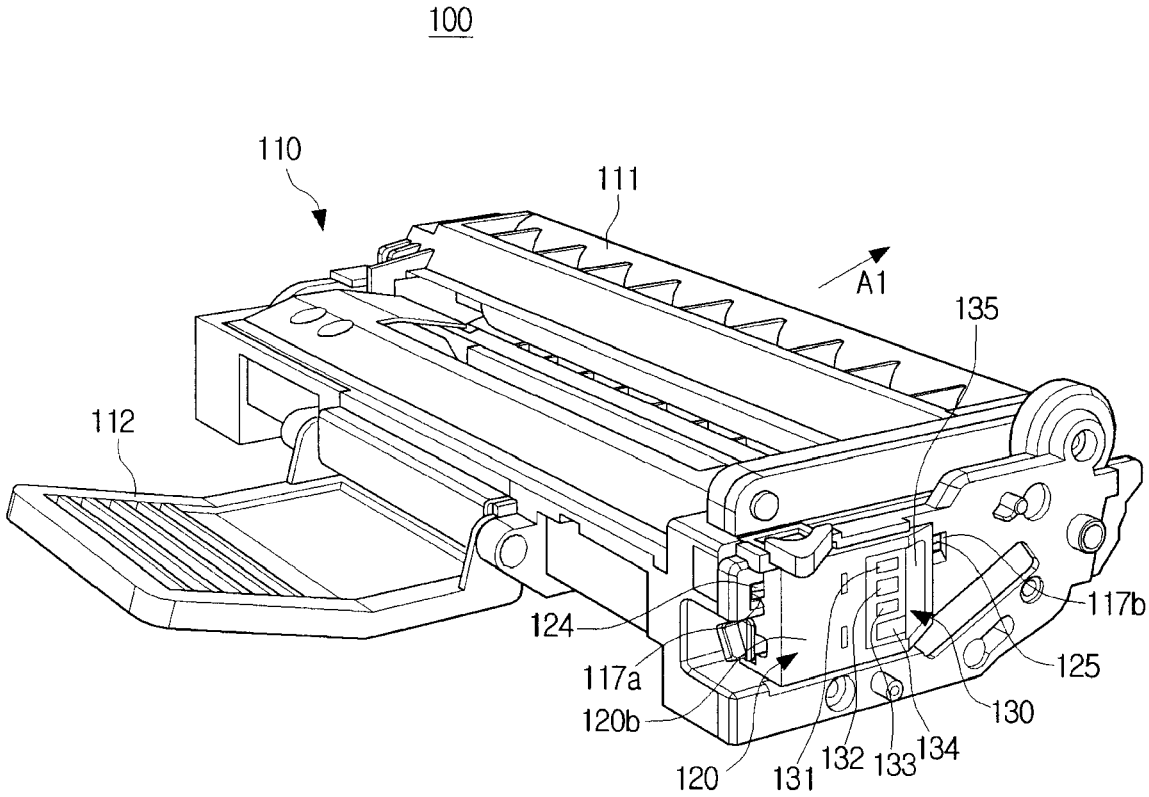

A handle 112 to be grasped by a user may be formed on the developing cartridge 110 so as to make the extraction of the developing cartridge 110 easier. The handle 112 may be folded toward the developing cartridge 110 when the developing cartridge 110 is mounted in the body 10, and may be unfolded from the developing cartridge 110 when the developing cartridge 110 is to be detached from the body 10, so the user can conveniently grasp the handle 112. As shown in FIGS. 3A and 3B, according to an embodiment, one end of the handle 112 may be pivotally fixed to the developing cartridge 110, so the opposite end of the handle 112 may rotate.

The developing cartridge 110 may include a developing cartridge body 111 having the external appearance shown in FIGS. 2 and 3. The developing cartridge body 111 may support therein a photoconductive medium 20, a developing roller 113 and a supply roller 114. The developing roller 113 develops a latent image of the photoconductive medium 20 using toner, and the supply roller 114 supplies the toner to the developing roller 113.

In this embodiment, the photoconductive medium 20 is housed in the developing cartridge 110, but this is merely an example. As it should be apparent to those skilled in the art, the photoconductive medium 20 may alternatively be provided separately on the image forming apparatus body 10 rather than in the developing cartridge body 111.

The developing cartridge 110 according to an embodiment may be inserted into the casing 12 in the direction indicated by the arrow A1 (see FIG. 1), which may be substantially perpendicular to the rotating shafts 113*a* and 114*a* of the developing roller 113 and the supply roller 114, and may be mounted in the casing 12. Accordingly, both side edges of the developing cartridge 110 may be supported in place between the casing 12 and the image forming apparatus body 10.

According to an embodiment, the developing cartridge body 111 may itself accommodate a quantity of toner, so as to allow a number of pages to be printed even without a supply of toner from the toner cartridge 120.

The toner cartridge 120 may be detachably supported in the developing cartridge 110. To this end, a recess 117 to house the toner cartridge 120 may be formed in the developing cartridge body 111.

The recess 117 is formed in the developing cartridge 110 with a predetermined depth so that the toner cartridge 120 may be inserted in the direction indicated by arrow B1 (see FIG. 3A), which may be substantially parallel to shafts 113*a* and 114*a* of the developing roller 113 and the supply roller 114.

The direction indicated by the arrow A1, in which the developing cartridge 110 is mounted in the body 10 of the image forming apparatus 1, may be referred to hereinafter as the first direction, and the direction indicated by the arrow B1, in which the toner cartridge 120 is mounted in the developing cartridge 110, may be referred to as the second direction.

Guide grooves 117*a* and 117*b* may be formed in the recess 117 in order to guide the toner cartridge 120 to be mounted as shown in FIG. 3A. Mounting guides 124 and 125 corresponding to the guide grooves 117*a* and 117*b* may be formed on the toner cartridge 120 as shown in FIG. 2. In this embodiment, two guide grooves 117*a* and 117*b* are formed on both surfaces of the recess 117, and two mounting guides 124 and 125 corresponding to two guide grooves 117*a* and 117*b* are formed in the toner cartridge 120, but the number of guide grooves and mounting guides is not so limited, and only one of each or more than two of each may alternatively be provided.

A blocking member (not shown) corresponding to the recess 117 may be mounted in the recess 117 in order to prevent the toner accommodated in the developing cartridge body 111 from leaking out when the toner cartridge 120 is not housed in the developing cartridge 110.

Figure 4:
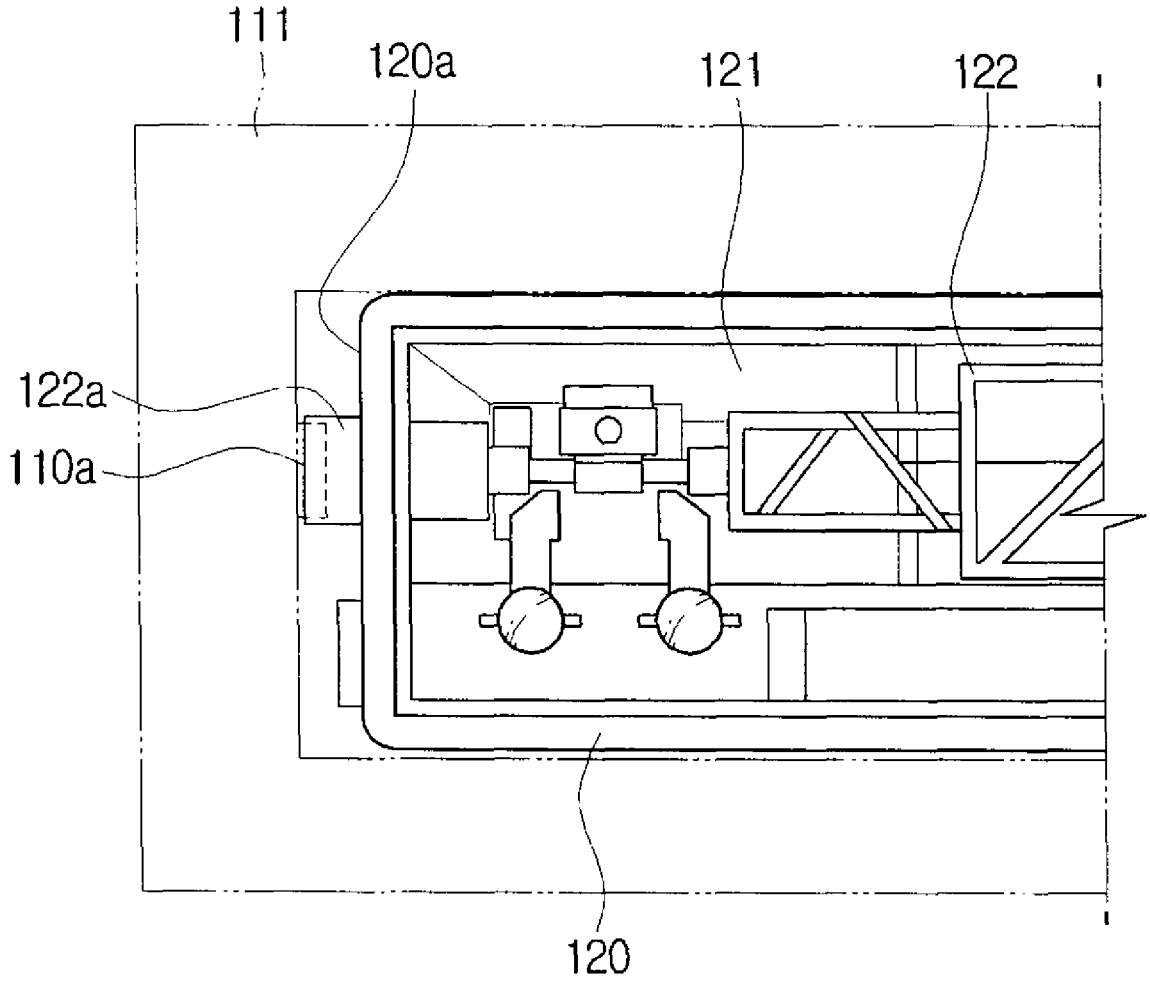
FIG. 4 is a sectional view showing the relevant internal features of a toner cartridge mounted in a developing cartridge according to an embodiment of the present invention.

A toner transferring member 122 may be rotatably mounted within the toner housing 121 containing the toner as shown in FIG. 4, and may supply the toner to the developing cartridge body 111. The toner transferring member 122 transfers the toner toward a toner supply opening 123 (referring to FIG. 2) formed on the bottom surface of the toner cartridge 120.

The toner contained in the toner housing 121 of the toner cartridge 120 is transferred to the toner supply opening 123 by the toner transferring member 122, then to the developing cartridge body 111 through the toner supply opening 123, and in turn sequentially to the supply roller 114, and to the developing roller 113, which uses the toner to develop a latent image formed on the photoconductive medium 20. According to an embodiment, first and second agitating members 115 and 116 may be rotatably mounted in the developing cartridge body 111 in order to agitate the toner prior to supplying the toner to the supply roller 114. While two agitating members are shown and described, the number of the agitating member (s) is not so limited, and any number of agitating members may alternatively be provided.

The developing roller 113, the supply roller 114, and the first and second agitating members 115 and 116 are provided in the developing cartridge 110 to sequentially transfer the toner in the developing cartridge 110.

When the toner cartridge 120 is mounted in the developing cartridge body 111, the transferring member 122 may be driven by a driving mechanism provided in the developing cartridge 110. The driving force may be transferred to the toner transferring member 122 at the leading end 120*a*, which is inserted first into the recess 117 based on the direction B1, in which the toner cartridge 120 is inserted into the recess 117.

A driven shaft 122*a* of the toner transferring member 122 protrudes from the front end 120*a* of the toner cartridge 120 as shown in FIG. 4. The driven shaft 122*a* is coupled to a driving shaft 110*a* of the developing cartridge body 111 (e.g., through engagement of one or more gears), thereby the toner transferring member 122 thereby receives the driving force.

According to an embodiment, the toner transferring member 122 may receive the driving force, e.g., from the developing roller 113 and/or the supply roller 114 formed in the developing cartridge body 111 through a gear train (not shown).

A memory 130 is mounted in the toner cartridge 120 for use in determining the condition of the toner cartridge 120. The memory 130 is capable of transmitting and/or receiving signals to and/or from the image forming apparatus 1 to allow the determination of, e.g., whether the toner cartridge 120 is mounted in the developing cartridge 110, the toner consumption, printing related information, or the like.

The memory 130 may be disposed at such location to be accessible from a surface of the toner cartridge 120 that is exposed externally from the developing cartridge body 111 when the toner cartridge 120 is mounted in the recess 117, so that a signal communication may be established between the memory 130 and the image forming apparatus 1.

For example, according to an embodiment, the memory 130 (or the access terminals thereof) may be disposed on the surface of the trailing end 120*b* of the toner cartridge 120 that trails the leading end 120*a* during mounting with respect to the direction indicated by the arrow B1, the trailing end 120*b* being exposed to the exterior of the developing cartridge body 111 when the toner cartridge 120 is properly mounted in the recess 117.

The memory 130 may include a plurality of terminals 131, 132, 133 and 134, which may be arranged, each with a predetermined length along the direction parallel to the direction of the arrow A1, and may make contact with contact 13 (e.g., a number of contacts each corresponding to one of the terminals 131, 132, 133, 134—for brevity sake collectively referred to as the contact 13) formed in the body 10 of the image forming apparatus 1. The contact 13 may be formed along a direction parallel to the direction in which the developing cartridge 110 is mounted, and may be, e.g., a plate spring of a predetermined length that protrudes into the casing 12.

According to an embodiment, at least one of the plurality of terminals 131, 132, 133 and 134 may be made to be longer than the others. The longest terminal may be, e.g., a ground terminal.

The plurality of terminals 131, 132, 133 and 134 in FIGS. 3A and 3B are referred to below as first to fourth terminals. The first terminal 131 may be used as a common collector voltage (Vcc) terminal to supply power, the second terminal 132 may be used as a data and/or control transmission terminal, the third terminal 133 may be used as a clock terminal to receive clock signals, and the fourth terminal 134 may be used as a ground terminal. The fourth terminal 134 may be longer than the other terminals 131, 132 and 133, and may be placed below the other terminals 131, 132 and 133. The fourth terminal 134 extends further than the other terminals 131, 132 and 133 in the direction indicated by arrow A1, so as to first contact the contact 13 attached to the body 10 of the image forming apparatus 1 when the developing cartridge 110 is mounted.

According to an embodiment, an oblique surface 135 may be provided as being sloped in the direction indicated by the arrow A1 to absorb the impact between the memory 130 and the contact 13 when the developing cartridge 110 is mounted in the body 10 of the image forming apparatus 1 as shown in FIG. 3B. The oblique surface 135 may act to reduce the impact between the terminals 131, 132, 133, 134 and the contact 13 when the developing cartridge 110 is mounted.

When the developing cartridge 110 is mounted in the body 10 in the direction indicated by the arrow A1, the oblique surface 135 presses the contact 13, which may be, e.g., a plate spring protruding towards the casing 12, so that the contact 13 gradually retracts due to the slope of the oblique surface 135 before contacting the terminals 131, 132, 133 and 134.

That is, the oblique surface 135 may be used to gradually press in the contact 13 as the developing cartridge 110 is being mounted in the body 10 of the image forming apparatus 1. To that end, the oblique surface 135 may be disposed at the upstream of the memory 130 with respect to the direction of the arrow A1, so that the oblique surface 135 may press the contact 13 prior to the terminals 131, 132, 133 and 134 coming into contact with the contact 13.

When the developing cartridge 110 housing the toner cartridge 120 is inserted in the body 10, with the above described arrangements, the memory 130 disposed on the toner cartridge 120 makes an electrical connection with the contact 13, and is able to transmit signals to and/or receive signals from the image forming apparatus 1.

The process of replacing the developing device of the image forming apparatus 1 according to an embodiment of the present invention will be explained with reference to FIGS. 1 to 4.

When the toner cartridge 120 needs to be replaced, e.g., when the toner is exhausted, the user detaches the developing cartridge 110 from the casing 12 in the direction indicated by the arrow A2 as shown in FIG. 1.

The user then detaches the empty toner cartridge 120 in the direction indicated by the arrow B2 as shown in FIG. 3A, and inserts a new toner cartridge 120 filled with a supply of toner into the developing cartridge body 111 along the recess 117 in the direction indicated by the arrow B1.

When the toner cartridge 120 is completely mounted in the recess 117, the memory 130 disposed on a trailing end 120*b* of the toner cartridge 120 is exposed to the exterior of the toner cartridge body 111 through the recess 117 as shown in FIG. 3B. Referring to FIG. 4, the driven shaft 122*a* is engaged with the driving shaft 110*a*, thereby driving the toner transferring member 122.

The developing cartridge 110 with the new toner cartridge 120 mounted enters the body 10 in the direction indicated by the arrow A1 in FIG. 1, and is mounted in the casing 12 of the body 10. The plurality of terminals 131, 132, 133 and 134 are parallel to the arrow A1, and are formed having a predetermined length, so the memory 130 establishes a contact with the body 10.

The plurality of terminals 131, 132, 133 and 134 contact the contact 13, so the information regarding, e.g., whether the toner cartridge 120 is mounted, the amount of remaining toner, or printing information may be transferred to the body 10 of the image forming apparatus 1.

According to an embodiment of the present invention, a replaceable toner cartridge that can be detachably installed in the developing cartridge, the replaceable toner cartridge including a memory, which is accessible through terminal or terminals disposed on the surface of the exposed end of the toner cartridge that remains exposed when the toner cartridge is installed in the developing cartridge.

According to an embodiment, the developing cartridge may be detachably mounted in an image forming apparatus. When the developing cartridge is mounted in place in the image forming apparatus, the terminal or terminals for accessing the memory come(s) in contact with contact terminal provided in the image forming apparatus so as to establish signal communication between the memory and the image forming apparatus.

Furthermore, the toner cartridge may house therein a toner transfer member that is driven from the opposite end to the exposed end.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A developing apparatus, comprising:

a developing cartridge having formed therein a recess having a depth extending into the developing cartridge;

a toner cartridge detachably mounted in the recess of the developing cartridge, the toner cartridge having an exposed surface that is at least partially exposed outside the developing cartridge when the toner cartridge is mounted in the recess; and a memory accessible via the exposed surface.

2. The developing apparatus of claim 1, further comprising:

a rotational member supported in the developing cartridge such that the rotational member is rotatable about a rotating shaft, wherein the toner cartridge is received into the recess in a first direction substantially parallel to the rotating shaft.

3. The developing apparatus of claim 2, wherein the recess comprises at least one guide groove parallel to the first direction, and the toner cartridge comprises at least one guide protrusion receivable into the at least one guide groove.

4. The developing apparatus of claim 2, wherein the memory being accessible through one or more access terminals arranged on the exposed surface, the developing cartridge being detachably supported in a body of an image forming apparatus, the developing cartridge being received into the body in a second direction substantially perpendicular to the rotating shaft, the one or more access terminals each having a respective length extending parallel to the second direction.

5. The developing apparatus of claim 4, wherein the one or more access terminals comprises a plurality of terminals, at least one of the plurality of terminals having its respective length longer than other ones of the plurality of terminals.

6. The developing apparatus of claim 5, wherein the at least one of the plurality of terminals is located closest to a bottom surface of the toner cartridge as compared with other ones of the plurality of terminals.

7. The developing apparatus of claim 5, wherein the at least one of the plurality of terminals is a ground terminal.

8. The developing apparatus of claim 4, wherein the exposed surface comprises a first surface, on which the one or more access terminals are supported, and an oblique surface formed upstream of the first surface with respect to the second direction.

9. The developing apparatus of claim 8, wherein the oblique surface slopes downward as moving away from the first surface in the second direction.

10. The developing apparatus of claim 2, wherein the rotational member comprises:

a photoconductive medium supported on a first rotational shaft;

a developing roller supported on a second rotational shaft, the developing roller being configured to rotate to thereby supply toner to the photoconductive member; and one or more toner transferring members supported on its own respective rotational shafts, the one or more toner transferring members being rotatable to cause a movement of toner toward the developing roller, wherein the first rotational shaft, the second rotational shaft and the respective rotational shafts of the one or more toner transferring members extend are substantially parallel to each other.

11. The developing apparatus of claim 1, wherein the toner cartridge includes a leading end, which first enters the recess when the toner cartridge is received into the recess, and a trailing end opposite the leading end, the exposed surface being an external surface of the trailing end, and wherein the toner cartridge comprises a toner transferring member supported on a driven shaft that receives a driving force from an external source at the leading end to thereby rotate the toner transferring member about the driven shaft to cause developer housed in the toner cartridge to move toward the developing cartridge.

12. The developing apparatus of claim 1, wherein the developing cartridge further comprises a foldable handle.

13. The developing apparatus of claim 1, wherein the memory comprises a customer replaceable unit monitor (CRUM).

14. An image forming apparatus, comprising:

a main body;

a developing cartridge detachably supported in the main body;

a toner cartridge detachably supported in the developing cartridge, the toner cartridge being configured to supply toner to the developing cartridge; and a memory accessible via an exposed surface of the toner cartridge, the exposed surface being at least partially exposed outside the developing cartridge when the toner cartridge is supported in the developing cartridge.

15. The image forming apparatus of claim 14, wherein the developing cartridge comprises a housing recess into which the toner cartridge is received, the exposed surface being exposed when the toner cartridge is received in the housing recess.

16. The image forming apparatus of claim 15, wherein the housing recess comprises at least one housing guide groove parallel to the first direction, and the toner cartridge comprises at least one guide protrusion receivable into the housing guide groove.

17. The image forming apparatus of claim 15, wherein the toner cartridge comprises:

a toner housing to accommodate toner therein;

a leading end, which first enters the housing recess when the toner cartridge is received into the housing recess;

a trailing end opposite the leading end, the exposed surface being an external surface of the trailing end, and a toner transferring member supported on a driven shaft that receives a driving force from an external source at the leading end to thereby rotate the toner transferring member about the driven shaft to cause developer accommodated in the toner housing to move toward the developing cartridge.

18. The image forming apparatus of claim 17, wherein the driven shaft of the toner transferring member protrudes outward away from the leading end of the toner cartridge.

19. The image forming apparatus of claim 14, wherein the developing cartridge comprises:

a rotational member supported in the developing cartridge such that the rotational member is rotatable about a rotating shaft, wherein the toner cartridge is received into the recess in a first direction substantially parallel to the rotating shaft, the developing cartridge being received in the main body of the image forming apparatus in a second direction substantially perpendicular to the rotating shaft.

20. The image forming apparatus of claim 19, wherein the rotational member comprises:

at least one of a photoconductive member, a developing roller and a supply roller, each supported on a respective rotating shaft.

21. The image forming apparatus of claim 19, further comprising:

one or more access terminals arranged on the exposed surface, the memory being accessible through the one or more access terminals, each of the one or more access terminals having a respective length extending parallel to the second direction; and one or more contacts arranged on the main body of the image forming apparatus such that each of the one or more contacts come into contact with corresponding respective one of the one or more access terminals to thereby establish signal communication between the memory and the image forming apparatus.

22. The image forming apparatus of claim 21, wherein the one or more contacts comprises at least one plate spring that retractably protrudes inwardly into the main body to be in pressing contact with the one or more access terminals.

23. The image forming apparatus of claim 21, wherein the one or more access terminals comprises a plurality of terminals, at least one of the plurality of terminals having its respective length longer than other ones of the plurality of terminals.

24. The image forming apparatus of claim 23, wherein the at least one of the plurality of terminals is located closest to a bottom surface of the toner cartridge as compared with other ones of the plurality of terminals.

25. The image forming apparatus of claim 23, wherein the at least one of the plurality of terminals is a ground terminal.

26. The image forming apparatus of claim 21, wherein the exposed surface comprises a first surface, on which the one or more access terminals are supported, and an oblique surface formed upstream of the first surface with respect to the second direction so that the oblique surface comes into contact with the one or more contacts first before the one or more access terminals as the developing cartridge moves into the main body.

27. The image forming apparatus of claim 26, wherein the oblique surface slopes downward as moving away from the first surface in the second direction.

28. The image forming apparatus of claim 14, wherein the memory comprises a customer replaceable unit monitor (CRUM).

29. A toner cartridge, comprising:

a toner cartridge body defining an inner volume in which to accommodate toner;

a toner transferring member rotatably mounted in the toner cartridge body, the toner transferring member being configured to receive, at a first end of the toner cartridge body, a driving force from an external driving force source, and configured to rotate to thereby move the toner in the toner cartridge body to an outside the toner cartridge; and a memory accessible through one or more access terminals arranged on a surface of a second end opposite the first end of the toner cartridge body when the toner cartridge is mounted.

30. The toner cartridge of claim 29, wherein the toner transferring member is supported on a rotating shaft that extends along a first direction, and wherein the one or more access terminals comprises a plurality of terminals each having a respective length extending in a second direction perpendicular to the first direction, at least one of the plurality of terminals having its respective length longer than other ones of the plurality of terminals.

31. The toner cartridge of claim 30, wherein the at least one of the plurality of terminals is located closest to a bottom surface of the toner cartridge body as compared with other ones of the plurality of terminals.

32. The toner cartridge of claim 31, wherein the surface of the second end comprises a first surface, on which the one or more access terminals are supported, and an oblique surface that slopes downward as moving away from the first surface along the second direction.

33. The toner cartridge of claim 29, wherein the memory comprises a customer replaceable unit monitor (CRUM).

34. An apparatus, comprising:

a memory accessing unit having a main body, the main body including one or more contact terminals;

a first detachable unit detachably supported in the main body, the first detachable unit being receivable into the main body in a first direction;

a second detachable unit detachably supported in the first detachable unit, the second detachable unit being receivable into the first detachable unit in a second direction perpendicular to the first direction, the second detachable unit including an exposed surface that is at least partially exposed outside the first detachable unit when the first detachable unit is received in the first detachable unit;

a memory accessible through one or more access terminals arranged on the exposed surface, the one or more access terminals coming into contact with the one or more contact terminals of the main body so as to establish signal communication between the memory and the memory accessing unit.

35. The apparatus of claim 34, wherein the memory accessing unit is configured to determine whether the first detachable unit is properly received into the main body by accessing the memory.

36. The apparatus of claim 34, wherein the one or more contacts comprises at least one plate spring that retractably protrudes inwardly into the main body to be in pressing contact with the one or more access terminals.

37. The apparatus of claim 34, wherein the one or more access terminals comprises a plurality of terminals, at least one of the plurality of terminals having its respective length longer than other ones of the plurality of terminals.

38. The apparatus of claim 37, wherein the at least one of the plurality of terminals is located closest to a bottom surface of the second detachable unit as compared with other ones of the plurality of terminals.

39. The apparatus of claim 34, wherein the exposed surface comprises a first surface, on which the one or more access terminals are supported, and an oblique surface formed upstream of the first surface with respect to the first direction so that the oblique surface comes into contact with the one or more contacts first before the one or more access terminals as the first detachable unit moves into the main body.

40. The apparatus of claim 39, wherein the oblique surface slopes downward as moving away from the first surface in the first direction.

41. The apparatus of claim 39, wherein the memory accessing unit is an image forming apparatus, the first detachable unit is a developing cartridge usable in the image forming apparatus, and the second detachable unit is a toner cartridge, and wherein the memory comprises a customer replaceable unit monitor (CRUM).

42. A memory device including a second unit received into a first unit in a first direction, a memory being disposed on a third unit received into the second unit in a second direction so as to allow a transfer of a signal between the first unit and the third unit, the memory device comprising:

four terminals formed on a portion of the third unit exposed externally from the second unit while the third unit is mounted in the second unit at a predetermined length in the first direction.

43. The memory device of claim 42, wherein one of the four terminals adjacent to a bottom surface of the third unit is a ground terminal.

44. The memory device of claim 43, wherein one of the four terminals adjacent to an upper surface of the third unit supplies voltage.

45. The memory device of claim 42, wherein the first unit is a body of an image forming apparatus, the second unit is a developing cartridge, and the third unit is a toner cartridge.

46. The memory device of claim 42, wherein the first unit comprises a plurality of contacts to contact the four terminals of the memory device.

47. The memory device of claim 46, wherein an oblique surface is formed on the third unit to absorb an impact between the four terminals and the plurality of contacts by coming into a pressing contact with the plurality of contacts when the second unit is mounted in the first unit.

48. The memory device of claim 47, wherein the oblique surface is formed at a location ahead of the memory with respect to the second direction in which the second unit is mounted into the first unit.

* * * * *